US008053043B2

(12) United States Patent
Beer et al.

(10) Patent No.: US 8,053,043 B2
(45) Date of Patent: Nov. 8, 2011

(54) RECORDING SHEET FOR INK JET PRINTING

(75) Inventors: Robert Beer, Marly (CH); Pierre-Alain Brugger, Ependes (CH); Vincent Ruffieux, Praroman-Le Mouret (CH); Martin Staiger, Westerstetten (DE); Rolf Steiger, Praroman-Le Mouret (CH)

(73) Assignee: ILFORD Imaging Switzerland GmbH (CH)

( * ) Notice: Subject to any disclaimer, the term of this patent is extended or adjusted under 35 U.S.C. 154(b) by 943 days.

(21) Appl. No.: 11/709,541

(22) Filed: Feb. 21, 2007

(65) Prior Publication Data

US 2007/0196596 A1 Aug. 23, 2007

(30) Foreign Application Priority Data

Feb. 21, 2006 (EP) ..... 06110239

(51) Int. Cl.
*B41M 5/40* (2006.01)

(52) U.S. Cl. ..... 428/32.16; 428/32.17; 428/32.21; 428/32.24; 428/32.25; 428/32.28; 428/32.29; 428/32.34; 428/32.35; 428/32.36

(58) Field of Classification Search ..... 428/32.17, 428/32.21, 32.24, 32.25, 32.28, 32.29, 32.34, 428/32.35, 32.36
See application file for complete search history.

(56) References Cited

U.S. PATENT DOCUMENTS

| | | | | |
|---|---|---|---|---|
| 6,156,419 | A | 12/2000 | Brugger et al. | |
| 6,773,771 | B1 | 8/2004 | Ashida et al. | |
| 2003/0072925 | A1* | 4/2003 | Kiyama et al. | 428/195 |
| 2004/0146665 | A1 | 7/2004 | Beer et al. | |
| 2006/0013971 | A1* | 1/2006 | Chen et al. | 428/32.34 |
| 2006/0078695 | A1 | 4/2006 | Beer et al. | |

FOREIGN PATENT DOCUMENTS

| | | | |
|---|---|---|---|
| DE | 100 20 346 | A1 | 11/2000 |
| EP | 0 298 424 | A2 | 1/1989 |
| EP | 0 298 424 | A3 | 1/1989 |
| EP | 0 631 013 | A1 | 12/1994 |
| EP | 0 875 394 | A1 | 11/1998 |
| EP | 0 983 867 | A2 | 8/2000 |
| EP | 1 346 840 | A1 | 9/2003 |
| EP | 1 364 800 | A1 | 11/2003 |
| EP | 1 437 228 | A1 | 7/2004 |
| EP | 1 655 348 | A1 | 5/2006 |
| WO | WO 0020221 | | 4/2000 |
| WO | WO 0105599 | A1 | 1/2001 |
| WO | WO 02094573 | A1 | 11/2002 |

OTHER PUBLICATIONS

G. Wyszechi and W.S. Stiles, "Color Science", John Wiley's Sons, 1982, ISBN 0-471-02106-7, pp. 164-169 and 829.
M. Fryberg, "Dyes for ink-jet printing", Review of Progress in Coloration 35, 1-30 (2005).
S. Brunauer, P.H. Emmett and E. Teller, "Adsorption of Gases in Multimolecular Layers", Journal of the American Chemical Society 60, 309-319 (1938).
S. Brunauer, L.S. Deming, W.E. Demings and E. Teller, "On a Theory of van der Waals Adsorption of Gases", Journal of the American Chemical Society 62, 1723-1732 (1940).
DIN En ISO 2813 "Bestimmung des Reflektometerwertes von Beschichtungen (ausser Metallic-Beschichtungen) unter 20°, 60° and 85°" (Jun. 1999) (in German).
ISO 15994 "Graphic Technology—Testing of prints—Visual Lustre" (2005).
Datasheet of AEROSIL® 200 (Dec. 2005).
Datasheet of AEROSIL® 200V (Jul. 2005).
Datasheet of CAB-O-SIL® M-5 (Apr. 2004).
Datasheet of Mowiol® (Oct. 2002).
Safety (MSDS) data for aluminium chlorohydrate.
Safety Data Sheet of Accepta 8308 (Aluminium Chlorohydrate).
Safety Data Sheet of Mystolene (Aluminium Chlorohydrate) (Apr. 2002).
OECD SIDS N-3(Trimethoxysilyl) Propyl) Ethylenediamine (AEAPTMS) (Aug. 2003).

* cited by examiner

*Primary Examiner* — Betelhem Shewareged
(74) *Attorney, Agent, or Firm* — Onofrio Law; Dara L. Onofrio, Esq.

(57) ABSTRACT

A recording sheet for ink jet printing is described, which consists of a support having coated onto said support at least two ink-receiving layers, wherein the ink-receiving layer situated next to the support contains nanoporous silicon dioxide with a positively charged surface and at least one binder and the ink-receiving layer situated further away from the support contains nanocrystalline, nanoporous aluminium oxide or aluminium oxide/hydroxide and at least one binder and, optionally, nanoporous silicon dioxide with a positively charged surface.

10 Claims, No Drawings

RECORDING SHEET FOR INK JET PRINTING

FIELD OF THE INVENTION

The present invention relates to a recording sheet for ink jet printing, characterized by the fact that the recording sheet has coated onto a support at least two ink-receiving layers, wherein the ink-receiving layer situated next to the support contains nanoporous silicon dioxide with a positively charged surface and at least one binder and the ink-receiving layer situated further away from the support contains nanocrystalline, nanoporous aluminum oxide or aluminum oxide/hydroxide and at least one binder and, optionally, nanoporous silicon dioxide with a positively charged surface.

BACKGROUND OF THE INVENTION

Ink jet printing processes are mainly of two types: continuous stream and drop-on-demand.

In continuous stream ink jet printing, a continuous ink stream is emitted under pressure through a nozzle. The stream breaks up into droplets at a certain distance from the nozzle. If a specific location on the recording sheet has to be printed the individual droplets are deposited on the recording sheet, otherwise they are directed to a collecting vessel. This is done for example by charging unnecessary droplets in accordance with digital data signals and passing them through a static electric field which adjusts the trajectory of these droplets in order to direct them to the collecting vessel. The inverse procedure may also be used wherein uncharged droplets are collected in the vessel.

In the non-continuous process, or the so-called "drop-on-demand" process, a droplet is generated and expelled from the nozzle in accordance with digital data signals only if a specific location on the recording sheet has to be printed.

The printing speed of modern ink jet printers is ever increasing for economical reasons. Recording sheets suitable for these printers therefore need to absorb the inks very quickly. Especially suitable are recording sheets containing nanoporous inorganic compounds, preferably oxides such as aluminum oxides or silicon dioxide, or oxide/hydroxides such as aluminum oxide/hydroxides. Such recording sheets are known as "nanoporous" recording sheets.

Nanoporous recording sheets for ink jet printing containing nanocrystalline, nanoporous aluminum oxide or aluminum oxide/hydroxide are described for example in patent application EP 0,298,424.

Image quality is improved in the case where the nanocrystalline, nanoporous aluminum oxide or aluminum oxide/hydroxide contains one or more elements of the rare earth metal series of the periodic system of the elements, as described for example in patent application EP 0,875,394.

It is an advantage if the positive charge of the surface of nanocrystalline, nanoporous aluminum oxide or aluminum oxide/hydroxide is increased by a treatment with aluminum chlorohydrate, as described for example in patent application EP 1,437,228.

Recording sheets containing nanocrystalline, nanoporous aluminum oxide or aluminum oxide/hydroxide show excellent image quality, very high gloss and excellent transparency due to the small particle size of the aluminum oxide or aluminum oxide/hydroxide. Ink absorption capacity is only sufficiently high with a sufficiently high quantity of aluminum oxide or aluminum oxide/hydroxide because its pore volume is relatively low. Because high quantities of aluminum oxide or aluminum oxide/hydroxide are needed in such recording sheets and the price of aluminum oxide or aluminum oxide/hydroxide is high, manufacturing costs of such recording sheets are high. Manufacturing speed is relatively low because high quantities of coating solutions need to be coated and dried for the ink-receiving layers.

Patent application DE 10,020,346 describes a recording sheet which contains silicon dioxide prepared in the gas phase with a size of the primary particles of at most 20 nm, wherein the surface of the silicon dioxide has been modified by a treatment with aluminum chlorohydrate.

Patent application WO 00/20,221 describes the reaction of silicon dioxide prepared in the gas phase with aluminum chlorohydrate. The modified silicon dioxide is incorporated afterwards into an ink-receiving layer of nanoporous recording sheets for ink jet printing.

Patent application WO 02/094,573 describes the use of silicon dioxide prepared in the gas phase in recording sheets for ink jet printing, wherein the surface of the silicon dioxide has been modified by a treatment with aminoorganosilanes.

Patent application WO 01/05,599 describes the use of silicon dioxide pigments in recording sheets for ink jet printing, wherein the surface of the silicon dioxide has been modified by a treatment with cationic aminoorganosiloxanes.

Patent application EP 0,983,867 describes the use of colloidal silicon dioxide in recording sheets for ink jet printing, wherein the surface of the silicon dioxide has been modified by a treatment with silanes of general formula $(R_1)_n Si(OR_2)_{4-n}$, wherein at least one of the substituents $R_1$ contains an amino group.

Patent application EP 1,655,348 describes a method of surface modification of nanoporous silicon dioxide, wherein the silicon dioxide is modified by a treatment with the reaction products of at least one aminoorganosilane with a compound of trivalent aluminum, for example aluminum chlorohydrate. The modified nanoporous silicon dioxide is incorporated afterwards into an ink-receiving layer of a nanoporous recording sheet for ink jet printing.

Nanoporous recording sheets for ink jet printing, having coated onto an ink-receiving layer containing nanoporous silicon dioxide with a pore radius between 4 nm and 25 nm, an ink-receiving layer containing nanocrystalline, nanoporous aluminum oxide/hydroxide, for example pseudo-boehmite, are described for example in patent application EP 0,631,013.

Recording sheets containing nanoporous silicon dioxide have an excellent ink absorption capacity even with a low quantity of nanoporous silicon dioxide because of its high pore volume. Because relatively low quantities of silicon dioxide are needed in such recording sheets and the price of silicon dioxide is relatively low, manufacturing costs of such recording sheets are quite low. Manufacturing speed is high because relatively low quantities of coating solutions need to be coated and dried for the ink-receiving layers. However, image quality as well as transparency of such recording sheets, are not very good.

Nanocrystalline, nanoporous aluminum oxide or aluminum oxide/hydroxide has a pore volume, which is lower by a factor of 1.4 to 2.0 than the pore volume of nanoporous silicon dioxide. Therefore, the quantity of nanocrystalline, nanoporous aluminum oxide or aluminum oxide/hydroxide needed for the absorption of a fixed amount of aqueous inks is higher by a factor of 1.4 to 2.0 than in the case of nanoporous silicon dioxide.

There is therefore a need to improve, in recording sheets for ink jet printing containing nanoporous inorganic compounds, in addition to ink absorption capacity, speed of ink absorption, water fastness, light stability and the like, in particular the image quality and the gloss with dye based inks and with pigment based inks. There is also a need to reduce manufacturing costs.

SUMMARY OF THE INVENTION

An objective of the invention is to provide a nanoporous recording sheet with improved image quality and lowered manufacturing costs. In particular, the excellent image quality of nanoporous recording sheets based on nanocrystalline, nanoporous aluminum oxide or aluminum oxide/hydroxide should be combined with the low manufacturing costs of nanoporous recording sheets based on nanoporous silicon dioxide.

We have now surprisingly found that this objective may be attained under suitable conditions with a recording sheet having coated onto a support at least two nanoporous ink-receiving layers, wherein the ink-receiving layer situated next to the support contains nanoporous silicon dioxide with a positively charged surface and at least one binder and the ink-receiving layer situated further away from the support contains nanocrystalline, nanoporous aluminum oxide or aluminum oxide/hydroxide and at least one binder.

In a preferred embodiment of the invention, the ink-receiving layer situated further away from the support additionally contains, besides the nanocrystalline, nanoporous aluminum oxide or aluminum oxide/hydroxide, nanoporous silicon dioxide with a positively charged surface, preferably in an amount between 0.5 percent by weight to 15 percent by weight relative to the total amount of aluminum oxide or aluminum oxide/hydroxide and silicon dioxide in this layer.

In another preferred embodiment of the invention, the recording sheet for ink jet printing contains an intermediate layer consisting of nanocrystalline, nanoporous aluminum oxide, nanocrystalline, nanoporous aluminum oxide/hydroxide or nanoporous silicon dioxide with a positively charged surface or a mixture of these compounds and no or only a small amount of binder, between the ink-receiving layer situated next to the support, containing nanoporous silicon dioxide with a positively charged surface, and the ink-receiving layer situated further away from the support, containing nanocrystalline, nanoporous aluminum oxide or aluminum oxide/hydroxide and, optionally, nanoporous silicon dioxide with a positively charged surface.

Such recording sheets have, at the same time, the excellent image quality of nanoporous recording sheets based on nanoporous aluminum oxide or nanoporous aluminum oxide/hydroxide and the high ink absorption capacity of nanoporous recording sheets based on nanoporous silicon dioxide.

DETAILED DESCRIPTION OF THE INVENTION

The recording sheet according to the invention has coated onto a support at least two nanoporous ink-receiving layers, wherein the ink-receiving layer situated next to the support contains nanoporous silicon dioxide with a positively charged surface and at least one binder and the ink-receiving layer situated further away from the support contains mostly nanocrystalline, nanoporous aluminum oxide or aluminum oxide/hydroxide and at least one binder.

Surprisingly, the image quality is not steadily improved in the case where the quantity of the nanoporous silicon dioxide with a positively charged surface in the lower ink-receiving layer and therefore the ink absorption capacity increase. Image quality is deteriorated when the quantity of nanoporous silicon dioxide with a positively charged surface in the ink-receiving layer situated next to the support is higher than 12.5 $g/m^2$. This quantity does not yet give, however, the required ink absorption capacity. This result is surprising. One would expect a steadily increasing image quality with the increasing quantity of nanoporous silicon dioxide with a positively charged surface, because absorption of the ink solvents is improved.

Image quality is improved in a preferred embodiment of the invention, when the ink-receiving layer situated further away from the support contains, in addition, besides the nanocrystalline, nanoporous aluminum oxide or aluminum oxide/hydroxide, nanoporous silicon dioxide with a positively charged surface, preferably in an amount between 0.5 percent by weight to 15 percent by weight relative to the total amount of aluminum oxide or aluminum oxide/hydroxide and silicon dioxide in this layer.

Image quality is also improved in another preferred embodiment of the invention, when the recording sheet for ink jet printing contains an intermediate layer consisting of nanocrystalline, nanoporous aluminum oxide, nanocrystalline, nanoporous aluminum oxide/hydroxide or nanoporous silicon dioxide with a positively charged surface or a mixture of these compounds and no or only a small amount of binder, between the ink-receiving layer situated next to the support, containing nanoporous silicon dioxide with a positively charged surface, and the ink-receiving layer situated further away from the support, containing nanocrystalline, nanoporous aluminum oxide or aluminum oxide/hydroxide and, optionally, nanoporous silicon dioxide with a positively charged surface in an amount between 0.5 percent by weight to 15 percent by weight relative to the total amount of aluminum oxide or aluminum oxide/hydroxide and silicon dioxide in this layer.

It has been observed that only the addition of nanoporous inorganic compounds having a pore volume of $\mu$ 20 ml/100 g, as determined by the BET isotherm method, to the ink-receiving layers considerably increases the absorption rate and the absorption capacity for aqueous inks. Only such inorganic compounds should be considered from now on as being "nanoporous".

The BET method is a method for measuring the surface area of a substance in powder form by adsorption of gases, wherein the specific surface area is determined from an adsorption isotherm. Pore volume is deduced from this isotherm, as described for example by S. Brunauer, P. H. Emmet and E. Teller in "Adsorption of Gases in Multimolecular Layers", Journal of the American Chemical Society 60, 309-319 (1938) and by S. Brunauer, L. S. Deming, W. E. Deming and E. Teller in "On a Theory of the van der Waals Adsorption of Gases", Journal of the American Chemical Society 62, 1723-1732 (1940).

An objective of the invention is to provide a low-cost nanoporous recording sheet with excellent image quality having the lowest possible pore volume for complete absorption of the inks.

For the recording sheet according to the invention, $\gamma$-$Al_2O_3$ is the preferred nanocrystalline, nanoporous aluminum oxide and pseudo-boehmite, an agglomerate of aluminum oxide/hydroxide of formula $Al_2O_3.n\,H_2O$, where n is from 1 to 1.5, is the preferred nanocrystalline, nanoporous aluminum oxide/hydroxide.

Nanocrystalline, nanoporous aluminum oxide/hydroxide treated with salts of the rare earth metal series, as described for example in patent application EP 0,875,394, is particularly preferred as nanocrystalline, nanoporous aluminum oxide/hydroxide for the recording sheet according to the invention. This nanocrystalline, nanoporous aluminum oxide/hydroxide contains one or more elements of the rare earth metal series of the periodic system of the elements with atomic numbers 57 to 71, preferably in a quantity from 0.2 mole percent to 2.5 mole percent relative to $Al_2O_3$.

The preferred aluminum oxide/hydroxide or aluminum oxide/hydroxide treated with lanthanum salts has a size of the primary particles between 5 nm and 15 nm.

Two different types of silicon dioxide may be used in the recording sheet according to the invention. The first one may be prepared by precipitation in a wet process (precipitated silicon dioxide) and the second one by a gas phase reaction (fumed silicon dioxide). This fumed silicon dioxide is generally prepared by flame pyrolysis, for example by burning silicon tetrachloride in the presence of hydrogen and oxygen. Examples of such fumed silicon dioxides are Aerosil® 200 and Aerosil® 200 V ($SiO_2$ having its isoelectric point at a value of pH of 2.0), both available from DEGUSSA AG, Frankfurt/Main, Germany. These two substances have, according to their data sheets, the same specific BET surface area of about 200 $m^2/g$ and the same size of the primary particles of about 12 nm. A further example is Cab-O-Sil® M-5, available from Cabot Corporation, Billerica, USA. This substance has, according to its data sheet, a specific BET surface area of about 200 $m^2/g$. The agglomerates have a length between 0.2 μm and 0.3 μm.

Fumed silicon dioxide having an average size of the primary particles of at most 20 nm and a specific BET surface area of at least 150 $m^2/g$, is particularly preferred for the recording sheet according to the invention.

The surface of nanoporous silicon dioxide prepared in this way is negatively charged. In order to allow the fixation of the normally negatively charged coloring compound contained in the inks, the surface of the nanoporous silicon dioxide needs to be modified in such a way that it becomes positively charged.

Silicon dioxide, wherein the surface has been modified by a treatment with aluminium chlorohydrate, is a preferred silicon dioxide with a positively charged surface for the recording sheet according to the invention.

Silicon dioxide, wherein the surface has been modified by a treatment with an aminoorganosilane, is also a preferred silicon dioxide with a positively charged surface for the recording sheet according to the invention.

Silicon dioxide, wherein the surface has been modified by a treatment with the reaction products of a compound of trivalent aluminum (such as aluminum chlorohydrate) with of at least one aminoorganosilane, is a particularly preferred silicon dioxide with a positively charged surface for the recording sheet according to the invention.

In the preparation of such surface modified silicon dioxide, fumed silicon dioxide, for example, is added at high shear rates to a mainly aqueous solution containing the reaction products of a compound of trivalent aluminum (such as aluminum chlorohydrate) with of at least one aminoorganosilane. Under suitable conditions, a dispersion of surface modified fumed silicon dioxide is obtained that does not coagulate. The mixture containing the reaction products of a compound of trivalent aluminum (such as aluminum chlorohydrate) with at least one aminoorganosilane has a high buffer capacity. The alkaline aminoorganosilane neutralizes the hydrochloric acid generated during the hydrolysis of the compound of trivalent aluminum (such as aluminum chlorohydrate). The required quantity of the compound of trivalent aluminum (such as aluminum chlorohydrate) for the surface modification of silicon dioxide is much lower in comparison to a modification with aluminum chlorohydrate only. These surface modified dispersions of silicon dioxide have a much lower salt content in comparison to dispersions where the surface has been modified with aluminum chlorohydrate.

The reaction products, used in the surface modification step, of a compound of trivalent aluminum (such as aluminum chlorohydrate) with at least one aminoorganosilane may be prepared by the addition of the aminoorganosilane to an aqueous solution of the compound of trivalent aluminum (such as aluminum chlorohydrate) or vice versa. The reaction of the compound of trivalent aluminium with the aminoorganosilane is carried out at temperatures from 10° C. to 50° C. for 5 minutes to 60 minutes. The reaction is preferably carried out at room temperature for 10 minutes to 15 minutes.

The modification of the surface of the silicon dioxide with the reaction products of a compound of trivalent aluminum (such as aluminum chlorohydrate) with at least one aminoorganosilane is a faster process than the surface modification of silicon dioxide with aluminum chlorohydrate. For this reason, the modification time may be shortened or the modification temperature may be lowered in the case where the surface of the silicon dioxide is modified with the reaction products of a compound of trivalent aluminum (such as aluminum chlorohydrate) with at least one aminoorganosilane.

Fumed silicon dioxide is particularly preferred for the surface modification with the reaction products of a compound of trivalent aluminum (such as aluminum chlorohydrate) with at least one aminoorganosilane.

In place of a single fumed silicon dioxide powder, a mixture of different silicon dioxide powders having different sizes of the primary particles may be used. The modification step with the reaction products of a compound of trivalent aluminum (such as aluminum chlorohydrate) with at least one aminoorganosilane may be carried out individually for each silicon dioxide powder or simultaneously with the mixture of the different silicon dioxide powders.

If the modification step is carried out at high shear rates, the reaction products are regularly distributed on the surface of the silicon dioxide. Furthermore, the rheological behavior of the dispersion is improved.

Preferred compounds of trivalent aluminum are aluminum chloride, aluminum nitrate, aluminum acetate, aluminum formiate and aluminum chlorohydrate.

Suitable aminoorganosilanes are aminoorganosilanes of formula (I)

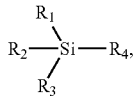

(I)

wherein $R_1$, $R_2$, $R_3$ independently represent hydrogen, hydroxyl, unsubstituted or substituted alkyl having from 1 to 6 carbon atoms, unsubstituted or substituted aryl, unsubstituted or substituted alkoxyl having from 1 to 6 carbon atoms or unsubstituted or substituted aryloxyl and $R_4$ represents an organic moiety substituted by at least one primary, secondary or tertiary amino group.

In the case where $R_1$, $R_2$ and $R_3$ are substituted, the substituents are independently selected from the group consisting of thiol, sulfide and polyalkylene oxide. Suitably selected substituents facilitate the surface modification of silicon dioxide (improved rheological behavior of the dispersions and of the coating solutions) and improve the properties of the recording sheets such as stability against air pollutants, light stability and physical properties.

Condensation products of the aminoorganosilanes may also be used in place of the monomeric aminoorganosilanes. The condensation reactions may occur between identical or different aminoorganosilanes.

Preferred aminoorganosilanes for the surface modification are 3-amino-propyltrimethoxysilane, N-(2-aminoethyl)-3-aminopropyltrimethoxysilane, (3-tri-ethoxysilylpropyl)-diethylentriamine, 3-aminopropyltriethoxysilane, N-(2-aminoethyl)-3-amino-propyltriethoxysilane, (3-triethoxysilylpropyl)-diethylenetriamine and their mixtures.

In a particularly preferred embodiment of the invention, the aminoorganosilane is reacted in solution with $CO_2$ under formation of an ammoniumorganosilane (protonated species of an aminoorganosilane) and hydrogen carbonate, before it is added to the solution of the trivalent aluminum compound (such as aluminum chlorohydrate). In this way, the value of pH of the reaction mixture containing the reaction products of a compound of trivalent aluminum (such as aluminum chlorohydrate) with at least one aminoorganosilane is lowered and its buffer capacity increased. The formation of undesirable, partially insoluble aluminum by-products of very high molecular weight is reduced in this procedure. The value of pH during the addition of the unmodified silicon dioxide is nearly unchanged.

The preferred silicon dioxide for the recording sheet according to the invention is fumed silicon dioxide with a size of the primary particles of at most 20 nm.

Fumed silicon dioxide, wherein the surface has been modified by a treatment with aluminum chlorohydrate, is a preferred silicon dioxide with a positively charged surface for the recording sheet according to the invention.

Fumed silicon dioxide, wherein the surface has been modified by a treatment with an aminoorganosilane, is also a preferred silicon dioxide with a positively charged surface for the recording sheet according to the invention.

Fumed silicon dioxide, wherein the surface has been modified by a treatment with the reaction products of a compound of trivalent aluminum (such as aluminum chlorohydrate) with of at least one aminoorganosilane, is a particularly preferred silicon dioxide with a positively charged surface for the recording sheet according to the invention.

The recording sheet according to the invention may contain, in addition to the nanoporous inorganic compounds, non-porous inorganic compounds according to the preceding definition.

The nanoporous ink-receiving layer situated next to the support contains, in addition to the binders, nanoporous silicon dioxide with a positively charged surface in a quantity between 5 g/m$^2$ and 25 g/m$^2$. Particularly preferred are quantities between 10 g/m$^2$ and 20 g/m$^2$. This layer contains from 10 percent by weight to 40 percent by weight of binders relative to the total weight of the layer. Particularly preferred is the range from 15 percent by weight to 30 percent by weight. Polyvinyl alcohol is the preferred binder in this layer.

The nanoporous ink-receiving layer situated further away from the support contains, in addition to the binders, nanocrystalline, nanoporous aluminum oxide, nanocrystalline, nanoporous aluminum oxide/hydroxide or nanocrystalline, nanoporous aluminum oxide/hydroxide containing one or more elements of the rare earth metal series and, optionally, nanoporous silicon dioxide with a positively charged surface or a mixture of these compounds in a quantity between 1 g/m$^2$ and 20 g/m$^2$. Particularly preferred are quantities between 3 g/m$^2$ and 15 g/m$^2$. This layer contains from 3 percent by weight to 20 percent by weight of binders relative to the total weight of the layer. Particularly preferred is the range from 5 percent by weight to 14 percent by weight. Polyvinyl alcohol is the preferred binder in this layer.

The intermediate layer, without or with only a small amount of binders, contains nanocrystalline, nanoporous aluminum oxide, nanocrystalline, nanoporous aluminum oxide/hydroxide or nanocrystalline, nanoporous aluminum oxide/hydroxide containing one or more elements of the rare earth metal series, nanoporous silicon dioxide with a positively charged surface or a mixture of these compounds in a quantity between 1 g/m$^2$ and 20 g/m$^2$. Particularly preferred are quantities between 2 g/m$^2$ and 10 g/m$^2$. This layer contains from 0 percent by weight to 20 percent by weight of binders relative to the total weight of the layer. Preferred is the range from 0.1 percent by weight to 10 percent by weight. Particularly preferred are, however, layers without binder. Polyvinyl alcohol is the preferred binder in this layer in the case where the layer contains a binder.

The binders are in most cases water-soluble polymers. Especially preferred are film-forming polymers.

The water-soluble polymers include for example natural polymers or modified products thereof such as albumin, gelatine, casein, starch, gum arabicum, sodium or potassium alginate, hydroxyethyl cellulose, carboxymethyl cellulose, α-, β- or γ-cyclodextrine and the like. In the case where one of the water-soluble polymers is gelatin, all known types of gelatin may be used as for example acid pigskin or limed bone gelatin, acid or base hydrolyzed gelatin, but also derivatised gelatins like for instance phthalaoylated, acetylated or carbamoylated gelatin or gelatin derivatised with the anhydride of trimellitic acid.

A preferred natural binder is gelatin.

Synthetic binders may also be used and include for example polyvinyl alcohol, polyvinyl pyrrolidone, completely or partially saponified products of copolymers of vinyl acetate with other monomers; homopolymers or copolymers of unsaturated carboxylic acids such as maleic acid, (meth)acrylic acid or crotonic acid and the like; homopolymers or copolymers of sulfonated vinyl monomers such as vinylsulfonic acid, styrene sulfonic acid and the like. Furthermore homopolymers or copolymers of vinyl monomers of (meth)acrylamide; homopolymers or copolymers of other monomers with ethylene oxide; polyurethanes; polyacrylamides; water-soluble nylon type polymers; polyesters; polyvinyl lactams; acrylamide polymers; substituted polyvinyl alcohol; polyvinyl acetals; polymers of alkyl and sulphoalkyl acrylates and methacrylates; hydrolysed polyvinyl acetates; polyamides; polyvinyl pyridines; polyacrylic acid; copolymers with maleic anhydride; polyalkylene oxides; copolymers with methacrylamide and copolymers with maleic acid may be used. All these polymers may also be used as mixtures.

A preferred synthetic binder is polyvinyl alcohol.

Polyvinyl alcohols with a degree of hydrolysis between 70% and 99%, in particular between 88% and 98%, and a molecular weight between 14,000 and 300,000, in particular between 100,000 and 200,000, are preferred; as well as mixtures of polyvinyl alcohols having different degrees of hydrolysis and/or different molecular weights.

These polymers may be blended with water insoluble natural or synthetic high molecular weight compounds, particularly with acrylate latices or with styrene acrylate latices.

Although not specifically claimed in this invention, water insoluble polymers have nevertheless to be considered part of the system.

The polymers mentioned above having groups with the possibility to react with a cross-linking agent may be cross-linked or hardened to form essentially water insoluble layers. Such cross-linking bonds may be either covalent or ionic. Cross-linking or hardening of the layers allows for the modification of the physical properties of the layers, like for instance their liquid absorption capacity or their resistance against layer damage.

The cross-linking agents or hardeners are selected depending on the type of the water-soluble polymers to be cross-linked.

Organic cross-linking agents and hardeners include for example aldehydes (such as formaldehyde, glyoxal or glutaraldehyde), N-methylol compounds (such as dimethylol urea or methylol dimethylhydantoin), dioxanes (such as 2,3-dihydroxydioxane), reactive vinyl compounds (such as 1,3,5-trisacrylolyl hexahydro-striazine or bis-(vinylsulfonyl) ethyl ether), reactive halogen compounds (such as 2,4-dichloro-6-hydroxy-s-triazine); epoxides; aziridines; carbamoyl pyridinium compounds or mixtures of two or more of the above mentioned cross-linking agents.

Inorganic cross-linking agents or hardeners include for example chromium alum, aluminum alum or boric acid.

The layers may also contain reactive substances that cross-link the layers under the influence of ultraviolet light, electron beams, X-rays or heat.

A wide variety of supports are known and commonly used in the art. They include all those supports used in the manufacture of photographic materials. This includes clear films made from cellulose esters such as cellulose triacetate, cellulose acetate, cellulose propionate or cellulose acetate/butyrate, polyesters such as polyethylene terephthalate or polyethylene naphthalate, polyamides, polycarbonates, polyimides, polyolefins, polyvinyl acetals, polyethers, polyvinyl chloride and polyvinylsulfones. Polyester film supports, and especially polyethylene terephthalate or polyethylene naphthalate are preferred because of their excellent dimensional stability characteristics. The usual opaque supports used in the manufacture of photographic materials may be used including for example baryta paper, polyolefin coated papers or voided polyester as for instance Melinex® manufactured by DuPont. Especially preferred are polyolefin coated papers or voided polyester.

When such supports, in particular polyester, are used, a subbing layer is advantageously coated first to improve the bonding of the ink-receiving layers to the support. Useful subbing layers for this purpose are well known in the photographic industry and include for example terpolymers of vinylidene chloride, acrylonitrile and acrylic acid or of vinylidene chloride, methyl acrylate and itaconic acid. In place of the use of a subbing layer, the surface of the support may be subjected to a corona-discharge treatment before the coating process.

Uncoated papers, comprising all different types of papers, varying widely in their composition and in their properties, and pigmented papers and cast-coated papers may also be used, as well as metal foils, such as foils made from aluminum.

The layers may also be coated onto textile fiber materials consisting for example of polyamides, polyesters, cotton, viscose and wool.

The ink-receiving layers according to the invention are coated in general from aqueous solutions or dispersions containing all necessary ingredients. In many cases, wetting agents are added to those coating solutions in order to improve the coating behavior and the evenness of the layers. Besides being necessary for coating purposes, these compounds may have an influence on the image quality and may therefore be selected with this specific objective in mind. Although not specifically claimed in this invention, wetting agents nevertheless form an important part of the invention.

In addition to the above mentioned ingredients, recording sheets according to the invention may contain additional compounds aimed at further improving their performance, as for example brightening agents to improve the whiteness, such as stilbenes, coumarines, triazines, oxazoles or others compounds known to someone skilled in the art.

Light stability may be improved by adding UV absorbers such as 2-hydroxybenzotriazoles, 2-hydroxybenzophenones, derivatives of triazine or derivatives of cinnamic acid. The amount of UV absorber may vary from 200 $mg/m^2$ to 2000 $mg/m^2$, preferably from 400 $mg/m^2$ to 1000 $mg/m^2$. The UV absorber may be added to any of the layers of the recording sheet according to the invention. It is preferred that, however, if it is added, it should be added to the topmost layer.

It is further known that images produced by ink jet printing may be protected from degradation by the addition of radical scavengers, stabilizers, reducing agents and antioxidants. Examples of such compounds are sterically hindered phenols, sterically hindered amines, chromanols, ascorbic acid, phosphinic acids and their derivatives, sulfur containing compounds such as sulfides, mercaptans, thiocyanates, thioamides or thioureas.

The above-mentioned compounds may be added to the coating solutions as aqueous solutions. In the case where these compounds are not sufficiently water-soluble, they may be incorporated into the coating solutions by other common techniques known in the art. The compounds may for example be dissolved in a water miscible solvent such as lower alcohols, glycols, ketones, esters, or amides. Alternatively, the compounds may be added to the coating solutions as fine dispersions, as oil emulsions, as cyclodextrine inclusion compounds or incorporated into latex particles.

Typically, the recording sheet according to the invention has a thickness in the range of 0.5 μm to 100 μm dry thickness, preferably in the range of 5 μm to 50 μm dry thickness.

The coating solutions may be coated onto the support by any number of suitable procedures. Usual coating methods include for example extrusion coating, air knife coating, doctor blade coating, cascade coating and curtain coating. The coating solutions may also be applied using spray techniques. The ink-receiving layers may be built up from several individual layers that may be coated one after the other or simultaneously. It is likewise possible to coat a support on both sides with ink-receiving layers. It is also possible to coat an antistatic layer or an anticurl layer on the backside. The selected coating method, however, is not to be considered limiting for the present invention.

Suitable coating procedures are cascade coating or curtain coating, wherein all the layers are coated simultaneously onto the support.

Inks for ink jet printing consist in essence of a liquid vehicle and a dye or pigment dissolved or suspended therein. The liquid vehicle for ink jet inks consists in general of water or a mixture of water and a water-miscible organic solvent such as ethylene glycol, higher molecular weight glycols, glycerol, dipropylene glycol, polyethylene glycol, amides, polyvinyl pyrrolidone, N-methylpyrrolidone, cyclohexyl pyrrolidone, carboxylic acids and their esters, ethers, alcohols, organic sulfoxides, sulfolane, dimethylformamide, dimethylsulfoxide, cellosolve, polyurethanes, acrylates and the like.

The non-aqueous parts of the ink generally serve as humefactants, cosolvents, viscosity regulating agents, ink penetration additives or drying agents. The organic compounds have in most cases a boiling point, which is higher than that of water. In addition, aqueous inks used for printers of the continuous stream type may contain inorganic or organic salts to increase their conductivity. Examples of such salts are sulfates, nitrates, chlorides, phosphates and salts of water-soluble organic acids such as acetates, oxalates and citrates. The dyes and pigments suitable for the preparation of inks useable with the recording sheets according to the invention cover practically all classes of known colouring compounds. Dyes typically used for this purpose are described by M. Fryberg in "Dyes for Ink-Jet Printing", Review of Progress in Coloration 35, 1-30 (2005). The recording sheets according to the invention are meant to be used in conjunction with most of the inks representing the state of the art.

The inks may further contain other additives such as surfactants, optical brighteners, UV absorbers, light stabilizers, biocides, precipitating agents such as multivalent metal compounds and polymeric additives.

This description of inks is for illustration only and is not to be considered as limiting for the purpose of the invention.

The present invention will be illustrated in more detail by the following examples without limiting the scope of the invention in any way.

Test Methods

1. Image Homogeneity

Patches of the 7 colors cyan, magenta, yellow, black, red, green and blue were printed onto the recording sheets according to the invention, as described later on in the examples, with the ink jet printer EPSON 890 (Printer settings: Premium Glossy Photo Paper, 720 dpi, High Speed) using original inks. At the same time, a continuous black wedge (0% to 100% of black) was printed onto each of these patches. After drying, coalescence was evaluated using the following rating:

Partial Value 0: The coloured wedge shows coalescence (flowing together of the ink) visible to the naked eye Partial Value 0.5: The coloured wedge shows coalescence, but only visible with a magnifying glass Partial Value 1: No coalescence visible, neither with the naked eye nor with a magnifying glass Subsequently, all the partial values were added for all the color wedges. This sum is a measure of image quality and is called here "Image Quality Value". Samples with good image quality have an Image Quality Value of 7, which means that none of the color wedges shows coalescence. Samples with very bad image quality have an Image Quality Value of 0, which means that all the color wedges show coalescence.

2. Gloss

Gloss is measured according to norms ISO 2813 and ISO 15994 with a glossmeter Micro-TRI-Gloss®, available from BYK Gardner, Columbia, USA. Values are given for a geometry of 60°.

3. Volume of Color Space (Gamut)

Patches of the colors yellow, red, magenta, blue, cyan, green and black at 100% print density were printed onto the recording sheets according to the invention with the ink jet printer EPSON 890 (Printer setting: Premium Glossy Photo Paper, 720 dpi, High Speed) using original inks.

The L*a*b* color coordinates of the colors yellow, red, magenta, blue, cyan, green, black and white were measured and the volume of the color space L*a*b*formed by these eight colors was calculated using the formulae of G. Wyszecki and W. Stiles in "Color Science Concepts and Methods, Quantitative Data and Formulae", John Wiley & Sons, 2nd edition 1982, ISBN 0-471-02106-7, pages 164-169 and page 829.

EXAMPLES AND RESULTS

Example 1

Preparation of Aluminum Oxide/Hydroxide Treated with Lanthanum Salts (2.2 Mole Percent Relative to $Al_2O_3$)

50 g of aluminum oxide/hydroxide HP 14/4 with a pore volume of 0.7 ml/g (available from SASOL AG, Hamburg, Germany) were dispersed for 15 minutes under vigorous mechanical stirring at a temperature of 20° C. in 948 g of bi-distilled water. Then, temperature was increased to 90° C. and stirring was continued for 15 minutes at this temperature. Afterwards, 2.04 g of crystalline LaCl3 (available from Fluka Chemie AG, Buchs, Switzerland) were added as solid and stirring was continued for 120 minutes. The solid was filtered off, washed three times with bi-distilled water and dried at a temperature of 110° C.

Preparation of Silicon Dioxide with a Modified Surface 9 g of aluminum chlorohydrate (Locron P, available from Clariant AG, Muttenz, Switzerland) were mixed at room temperature with 775.8 g of deionised water. The value of pH of this solution was 4.29. Afterwards, 9.1 g of N-(2-aminoethyl)-3-aminopropyltrimethoxysilane (available from Degussa, Düsseldorf, Germany) were added and stirring was continued for 5 minutes. Then, 206 g of fumed silicon dioxide (Cab-O-Sil® M-5, available from Cabot Corporation, Billerica, USA) were added within 30 minutes in small portions under ultrasound treatment. Temperature was increased to 50° C. and stirring was continued for 50 minutes. Finally, the dispersion was cooled down to a temperature of 20° C. using a cooling speed of 1° C. per minute.

The dispersion contains 20.6 percent by weight of Cab-O-Sil® M-5. Its BET pore volume is 1.4 ml/g of silicon dioxide.

Lower Nanoporous Layer

After vigorous mechanical stirring during 2 hours, 58.25 g of this dispersion of silicon dioxide with a modified surface were diluted with 7.68 g of deionised water under vigorous mechanical stirring. Afterwards, wetting agents and 27 g of an aqueous solution (10%) of polyvinyl alcohol Mowiol 40-88 (available from Clariant AG, Muttenz, Switzerland) were added and the mixture was treated for 2 minutes with ultrasound. Finally, 5.5 g of a solution (10%) of boric acid in a mixture of water and methanol (3:1) were added and the final weight was adjusted to 100 g with deionized water.

140 g/$m^2$ of this coating solution were coated at a temperature of 40° C. onto a polyethylene coated paper support. The coated support was then dried for 60 minutes at a temperature of 30° C.

1 $m^2$ of the coated support contains 16.8 g of $SiO_2$. Therefore, the pore volume of this nanoporous layer is 23.5 ml/$m^2$.

Upper Nanoporous Layer 16.2 g of aluminum oxide/hydroxide treated with lanthanum salts, as described above, with a pore volume of 0.7 ml/g were dispersed at a temperature of 40° C. in a mixture of 37.15 g of deionised water and 2.92 g of an aqueous solution (9%) of lactic acid. Then, 8.74 g of the aqueous dispersion of Cab-O-Sil® M-5, as described above, were added and stirring was continued for 5 minutes. Afterwards, 7.2 g of an aqueous solution (9%) of polyvinyl alcohol Mowiol 26-88 (available from Clariant AG, Muttenz, Switzerland), 16 g of an aqueous solution (9%) of polyvinyl alcohol Mowiol 56-98 (available from Clariant AG, Muttenz, Switzerland) and wetting agents were added and the mixture was treated for 3 minutes with ultrasound. Finally, 4.6 g of a solution (10%) of boric acid in a mixture of water and methanol (3:1) were added and the final weight was adjusted to 100 g with deionised water.

24 g/m$^2$ of this coating solution were coated at a temperature of 40° C. onto the polyethylene coated paper support already coated with the lower nanoporous layer. The coated support was then dried for 60 minutes at a temperature of 30° C.

1 m$^2$ of the coated support contains, in the upper layer, 3.89 g of aluminum oxide/hydroxide treated with lanthanum salts and 0.43 g of $SiO_2$. Therefore, the pore volume of this nanoporous layer is 3.3 ml/m$^2$.

1 m$^2$ of this recording sheet has therefore a pore volume of 26.8 ml.

After printing using the ink jet printer EPSON 890, the recording sheet had an Image Quality Value of 7.

Example 2

13 g of aluminum oxide/hydroxide HP 14/4 treated with lanthanum salts, as described above, with a pore volume of 0.7 ml/g were dispersed for 15 minutes under vigorous mechanical stirring at a temperature of 40° C. in a mixture of 58.84 g of deionised water and 3.24 g of an aqueous solution (9%) of lactic acid. Then, wetting agents, 4.77 g of an aqueous solution (10%) of polyvinyl alcohol Mowiol 26-88 and 10.59 g of an aqueous solution (9%) of polyvinyl alcohol Mowiol 56-98 were added and the resulting mixture was treated for 3 minutes with ultrasound. Finally, 5.5 g of a solution (10%) of boric acid in a mixture of water and methanol (3:1) were added and the final weight was adjusted to 100 g with deionised water.

36 g/m$^2$ of this coating solution were coated at a temperature of 40° C. onto the polyethylene coated paper support already coated with the lower nanoporous layer of example 1. The coated support was then dried for 60 minutes at a temperature of 30° C.

1 m$^2$ of the coated support contains, in the upper layer, 4.7 g of aluminium oxide/hydroxide HP 14/4 treated with lanthanum salts. Therefore, the pore volume of this upper nanoporous layer is 3.3 ml/m$^2$.

1 m$^2$ of this recording sheet has therefore a pore volume of 26.8 ml.

After printing using the ink jet printer EPSON 890, the recording sheet had an Image Quality Value of 3.

Example 3

This example corresponds to example 1 with the difference that the lower layer contains 12.5 g/m$^2$ (instead of 16.8 g/m$^2$) of silicon dioxide with a positively charged surface and the upper layer contains 12.0 g/m$^2$ (instead of 4.3 g/m$^2$) of the mixture of aluminum oxide/hydroxide treated with lanthanum salts and silicon dioxide with a positively charged surface.

1 m$^2$ of this recording sheet has therefore also a pore volume of 26.8 ml.

After printing using the ink jet printer EPSON 890, the recording sheet had an Image Quality Value of 7.

Example 4

This example corresponds to example 2 with the difference that the lower layer contains 12.5 g/m$^2$ (instead of 16.8 g/m$^2$) of silicon dioxide with a positively charged surface and the upper layer contains 13.1 g/m$^2$ (instead of 4.7 g/m$^2$) of aluminum oxide/hydroxide treated with lanthanum salts.

1 m$^2$ of this recording sheet has therefore also a pore volume of 26.8 ml. After printing using the ink jet printer EPSON 890, the recording sheet had an Image Quality Value of 7.

Examples 5a-5g

The lower nanoporous layer corresponds to the lower nanoporous layer of example 1 with the difference that the amount of silicon dioxide is 16.3 g/m$^2$ (instead of 16.8 g/m$^2$) and that therefore its pore volume is 22.7 ml/m$^2$ (instead of 23.5 ml/m$^2$).

In the upper nanoporous layer, the ratio between the quantity of nanocrystalline, nanoporous aluminum oxide/hydroxide treated with lanthanum salts and the quantity of nanoporous silicon dioxide with a positively charged surface was varied, as indicated in Table 1.

TABLE 1

| Example | Amount of silicon dioxide (percent by weight) | Amount of aluminum oxide/hydroxide treated with lanthanum salts (percent by weight) |
|---|---|---|
| 5a | 0 | 100 |
| 5b | 5 | 95 |
| 5c | 10 | 90 |
| 5d | 15 | 85 |
| 5e | 20 | 80 |
| 5f | 25 | 75 |
| 5g | 30 | 70 |

All the recording sheets have a pore volume of 26 ml/m$^2$.

After printing using the ink jet printer EPSON 890, all the recording sheets had an Image Quality Value of 7, with the exception of example 5a.

The results of gloss measurement, the calculated colour saturation and the Image Quality Value are indicated in Table 2.

TABLE 2

| Example | Gloss | Colour saturation | Image Quality Value |
|---|---|---|---|
| 5a | 52.6 | 344'000 | 3 |
| 5b | 53 | 343'791 | 7 |
| 5c | 44 | 322'324 | 7 |
| 5d | 39 | 294'000 | 7 |
| 5e | 35 | 271'752 | 7 |
| 5f | 33 | 267'345 | 7 |
| 5g | 29 | 249'519 | 7 |

The results in Table 2 show that image homogeneity is bad in the case where the upper nanoporous layer does not contain any silicon dioxide with positively charged surface in addition to the aluminum oxide/hydroxide treated with lanthanum salts. Image homogeneity is improved in the case where the upper nanoporous layer contains silicon dioxide with a positively charged surface in addition to the aluminum oxide/hydroxide treated with lanthanum salts. Gloss and color saturation decrease in the case where the amount of silicon dioxide with a positively charged surface in the upper nanoporous layer exceeds 5 percent by weight. Amounts above 15 percent by weight of silicon dioxide with a positively charged surface in the upper nanoporous layer give rise to recording sheets with unacceptable image quality for the reasons of low gloss and small color space.

Examples 6a-6d

Preparation of Silicon Dioxide with a Modified Surface minutes at a temperature of 20° C. in a mixture of 68.54 g of deionised water and 1.0 g of an aqueous solution (9%) of lactic acid using ultrasound agitation. Afterwards, 3.62 g of Locron P were added, the mixture was heated to a temperature of 25° C. and stirring was continued for 3 hours at this temperature. Then, temperature was increased to 40° C. The value of pH of this dispersion was 3.39. After the addition of 4.84 g of an aqueous solution (10%) of potassium hydroxide and adjustment of the weight to 100 g, the value of pH of the dispersion was 3.71. Finally, the mixture was treated with ultrasound for another minute.

Lower Nanoporous Layer

After vigorous mechanical stirring for a further 2 hours, 50 g of this dispersion of silicon dioxide with a modified surface were diluted at a temperature of 40° C. with 7.68 g of deionised water under vigorous mechanical stirring. Afterwards, wetting agents and 33.73 g of an aqueous solution (7.5%) of polyvinyl alcohol Mowiol 56-98 were added and the mixture was treated for 2 minutes with ultrasound. Finally, 4 g of a solution (10%) of boric acid in a mixture of water and methanol (3:1) were added and the final weight was adjusted to 100 g with deionised water.

113.6 g/m$^2$ of this coating solution were coated at a temperature of 40° C. onto an opaque polyester support. The coated support was then dried for 60 minutes at a temperature of 30° C.

this nanoporous layer is 13.7 ml/m$^2$.

Upper Nanoporous Layer 10.8 g of aluminum oxide/hydroxide HP 14/4 treated with lanthanum salts of example 1 were dispersed at a temperature of 40° C. in a mixture of 62.43 g of deionised water and 1.94 g of an aqueous solution (9%) of lactic acid. Then, 8.74 g of the aqueous dispersion of Aerosil 200 V, as described above, were added slowly under vigorous mechanical stirring. Afterwards, wetting agents, 4.16 g of an aqueous solution (10%) of polyvinyl alcohol Mowiol 26-88 and 11.09 g of an aqueous solution (7.5%) of polyvinyl alcohol Mowiol 56-98 were added. Finally, 3.12 g of an aqueous solution (10%) of boric acid were added and the final weight was adjusted to 100 g with deionised water.

Different quantities of this coating solution were coated at a temperature of 40° C. onto the opaque polyester support already coated with the lower nanoporous layer. The coated support was then dried for 60 minutes at a temperature of 30° C.

The coated quantities for the upper layer, the resulting pore volume and the Image Quality Values are indicated in Table 3.

TABLE 3

| Example | Quantity of the coating solution of the upper layer (g/m$^2$) | Pore volume (ml/m$^2$) | Image Quality Value |
|---|---|---|---|
| 6a | 47.5 | 17.9 | 2.5 |
| 6b | 65.0 | 19.5 | 3.5 |
| 6c | 77.5 | 20.6 | 4.0 |
| 6d | 95 | 22.3 | 5.5 |

A comparison of the results in Table 2 immediately shows that image homogeneity improves with increasing coating quantity and increasing pore volume of the upper nanoporous layer.

Example 7

The coating solution of the lower nanoporous layer is identical to the coating solution of the lower nanoporous layer of example 6a, but coating quantity onto the support was increased to 100 g/m$^2$ (instead of 56.8 g/m$^2$). The upper nanoporous layer is the same as in example 6b.

Therefore, 1 m$^2$ of this recording sheet has a pore volume of 30 ml.

After printing using the ink jet printer EPSON 890, the recording sheet (which contains a mixture of nanocrystalline, nanoporous aluminum oxide/hydroxide treated with lanthanum salts and silicon dioxide with a positively charged surface in the upper nanoporous layer) had an Image Quality Value of 5.5.

Example 8

The lower nanoporous layer is identical to the lower nanoporous layer of example 7. The coating solution of the upper nanoporous layer is identical to the coating solution of example 2, but coating quantity was increased to 63.5 g/m$^2$ (instead of 36 g/m$^2$).

Therefore, 1 m$^2$ of this recording sheet also has a pore volume of 30 ml. After printing using the ink jet printer EPSON 890, the recording sheet (which contains only nanocrystalline, nanoporous aluminum oxide/hydroxide treated with lanthanum salts in the upper nanoporous layer) had an Image Quality Value of 1.5, a value considerably lower than that of example 7.

Examples 9a-9d

Coating Solution of the Lower Nanoporous Layer 60.7 g of the dispersion of silicon dioxide with a modified surface of example 1 were heated, under vigorous mechanical stirring, to a temperature of 40° C. Afterwards, wetting agents and 33.8 g of an aqueous solution (8%) of polyvinyl alcohol Mowiol 40-88 were added and the mixture was treated for 2 minutes with ultrasound. Finally, 5 g of a solution (10%) of boric acid in a mixture of water and methanol (3:1) were added under vigorous mechanical stirring and the final weight was adjusted to 100 g with deionised water.

Coating Solution of the Intermediate Layer 340 g of aluminum oxide/hydroxide treated with lanthanum salts of example 1 were dispersed a temperature of 40° C. under vigorous mechanical stirring in a mixture of 573.3 g of deionised water and 84.7 g of an aqueous solution (9%) of lactic acid. Afterwards, wetting agents were added. The coating solution does not contain any binder.

Coating Solution of the Upper Nanoporous Layer 62.8 g of the dispersion of the intermediate layer were heated under vigorous mechanical stirring to a temperature of 40° C. in a mixture of 62.43 g of deionised water and 1.94 g of an aqueous solution (9%) of lactic acid. Afterwards, 7.3 g of an aqueous solution (10%) of polyvinyl alcohol Mowiol 26-88, 22.7 g of an aqueous solution (7.5%) of polyvinyl alcohol Mowiol 56-98 and wetting agents were added. Finally, 5 g of an aqueous solution (4%) of boric acid were added under vigorous mechanical stirring and the final weight was adjusted to 100 g with deionised water.

Coatings

The three coating solutions were coated simultaneously at a temperature of 40° C. with the aid of a multi-layer coating device onto a polyethylene coated paper support. The quantities of the pigments in the different layers are indicated in Table 4.

TABLE 4

| Example | Lower nanoporous layer ($g/m^2$) | Intermediate layer ($g/m^2$) | Upper nanoporous layer ($g/m^2$) |
|---|---|---|---|
| 9a | 12.0 | 2.1 | 14.2 |
| 9b | 12.0 | — | 16.3 |
| 9c | 16.0 | 4.1 | 4.2 |
| 9d | 16.0 | — | 8.3 |

The recording sheets of example 9a and of example 9b have the same amount of nanocrystalline, nanoporous aluminum oxide/hydroxide treated with lanthanum salts and the same amount of nanoporous silicon dioxide with a positively charged surface in their layers. The same is true for the recording sheets of example 9c and of example 9d.

All four recording sheets have a pore volume of 28.2 $ml/m^2$.

The homogeneities of images on these recording sheets are indicated in Table 5. Visual inspection with a rating going from 5 (worst) to 1 (best) was used.

TABLE 5

| Example | Homogeneity of images (Printer EPSON 750) | Homogeneity of images (Printer EPSON 7600) |
|---|---|---|
| 9a | 2 | 2 |
| 9b | 4 | 5 |
| 9c | 1 | 1 |
| 9d | 3 | 2 |

The results in Table 5 immediately show that images on the recording sheets which contain an intermediate layer without binder (examples 9a and 9c) have a better homogeneity than images on the recording sheets, which do not contain such an intermediate layer (examples 9b and 9d).

The foregoing description of various and preferred embodiments of the present invention has been provided for purposes of illustration only, and it is understood that numerous modifications, variations and alterations may be made without departing from the scope and spirit of the invention as set forth in the following claims.

The invention claimed is:

1. Recording sheet for ink jet printing, having coated onto a support at least two ink-receiving layers, each consisting of binders and at least one nanocrystalline, nanoporous compound, wherein the ink-receiving layer situated next to the support contains nanoporous silicon dioxide with a positively charged surface and the ink-receiving layer situated further away from the support contains nanocrystalline, nanoporous aluminum oxide/hydroxide and an intermediate layer without any binder between the two ink-receiving layers.

2. Recording sheet for ink jet printing according to claim 1, wherein the nanoporous silicon dioxide with a positively charged surface has an average size of the primary particles of at most 20 nm and the aluminum oxide/hydroxide has an average size of the primary particles between 5 nm and 15 nm.

3. Recording sheet for ink jet printing according to claim 1, wherein the ink-receiving layer situated further away from the support contains, in addition, silicon dioxide with a positively charged surface.

4. Recording sheet for ink jet printing according to claim 3, wherein the amount of silicon dioxide with a positively charged surface is from 0.5 percent by weight to 15 percent by weight relative to the total amount of nanocrystalline, nanoporous aluminum oxide/hydroxide and silicon dioxide with a positively charged surface in this layer.

5. Recording sheet for ink jet printing according to claim 1, wherein said intermediate layer consists of nanocrystalline, nanoporous aluminum oxide/hydroxide, nanoporous silicon dioxide with a positively charged surface or a mixture of these compounds.

6. Recording sheet for ink jet printing according to claim 1, wherein the nanocrystalline, nanoporous aluminum oxide/hydroxide contains one or more of the elements of the rare earth metal series of the periodic system of the elements with atomic numbers 57 to 71 in an amount of from 0.2 mole percent to 2.5 mole percent relative to $Al_2O_3$.

7. Recording sheet for ink jet printing according to claim 1, wherein the nanoporous silicon dioxide with a positively charged surface is fumed silicon dioxide, and the surface of it has been modified by a treatment with aluminum chlorohydrate, an aminoorganosilane or the reaction products of at least one aminoorganosilane with a compound of trivalent aluminum.

8. Recording sheet for ink jet printing according to claim 1, wherein the binder is polyvinyl alcohol.

9. Recording sheet for ink jet printing according to claim 1, wherein the support is selected from the group consisting of coated or uncoated paper, transparent or opaque polyester or polypropylene and fibrous textile materials.

10. Recording sheet for ink jet printing according to claim 1, wherein the recording sheet is manufactured by extrusion coating, air knife coating, doctor blade coating, cascade coating or curtain coating.

* * * * *